United States Patent [19]

Griffith

[11] 3,987,450

[45] Oct. 19, 1976

[54] OPEN RECTANGULAR ANTENNA CONDUCTIVELY SUPPORTED ON MAST

[76] Inventor: Howard E. Griffith, 1011 Hicks St., West Monroe, La. 71291

[22] Filed: Dec. 19, 1975

[21] Appl. No.: 642,445

[52] U.S. Cl. ..... 343/743; 343/767

[51] Int. Cl.[2] ..... H01Q 11/14

[58] Field of Search ..... 343/741, 743, 767, 803, 343/804, 908

[56] References Cited

UNITED STATES PATENTS

| | | | |
|---|---|---|---|
| 2,755,465 | 7/1956 | Ramsay | 343/741 |
| 2,825,061 | 2/1958 | Rowland | 343/767 |

*Primary Examiner*—Eli Lieberman

*Attorney, Agent, or Firm*—Cushman, Darby & Cushman

[57] ABSTRACT

A pair of conductive members oriented in coplanar relationship are joined at their ends to a common length of a grounded conductive support element. A first piece of conductive material extends from the center of one member to the center of the common length of the support element. A second piece of conductive material extends between the center of the other member and a point on said other member adjacent to its junction with the support element. The second piece of material is formed to define a gap between the material and the center of the common length of the support element, and means are provided to supply energy to the second piece of material at a point intermediate the gap location and that end of the material which is adjacent the support element.

14 Claims, 5 Drawing Figures

CONFIGURATION FOR
VERTICAL POLARIZATION

CONFIGURATION FOR
HORIZONTAL POLARIZATION

OPEN RECTANGULAR ANTENNA CONDUCTIVELY SUPPORTED ON MAST

BACKGROUND AND SUMMARY OF THE INVENTION

Antenna design is of critical importance in being able to transmit signals with high strength and having desired directional characteristics. Improvements in antenna performance in this regard are usually accomplished by corresponding increases in the complexity, and cost, of the antenna.

The present invention relates to an improved antenna element, particularly suited for television transmission, having a design which is relatively simple to produce and which facilitates grouping of two or more such elements to expand the range and directional properties of the antenna.

Briefly, an antenna element according to a preferred embodiment of the invention comprises a central support tube to which the ends of a pair of bent tubular members are secured, each tubular member and the support tube defining a substantially rectangular outline. The tubular members preferably are arranged to be coplanar and are attached to opposite sides of the support tube such that the two members define a large rectangle. A straight length of tubing extends from the center of one tubular member to the support tube at a point substantially midway between the locations where the tubular member joins the support tube. From the center of the other tubular member an L-shaped tubing extends to re-join the member at a location slightly displaced from the point where the member meets the support tube. Energy is supplied to the antenna element by a connection to the L-shaped tubing intermediate its bend and the point where it rejoins the tubular member.

DETAILED DESCRIPTION OF THE INVENTION

Referring now to the drawings, the invention will be described in greater detail.

Figure 1:
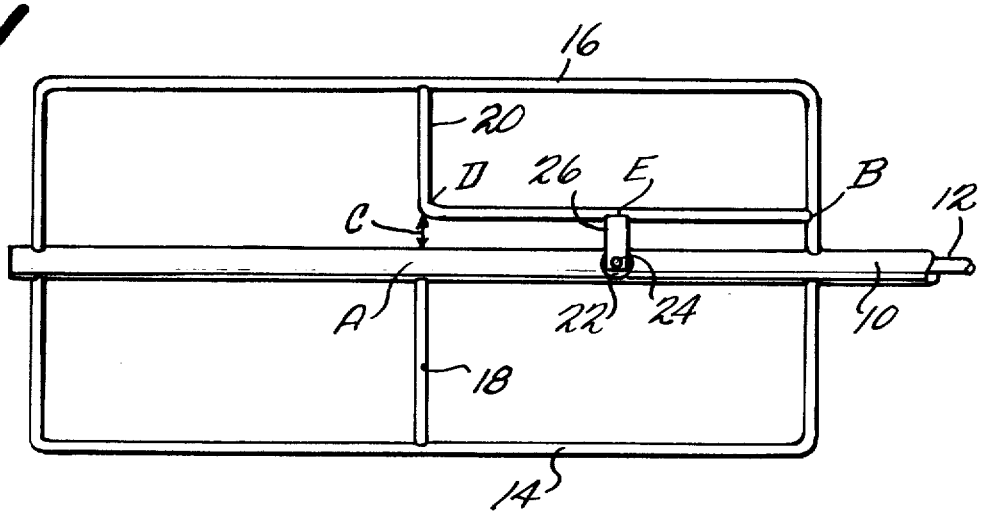
FIG. 1 is an elevational view of an antenna element constituting a preferred embodiment of the invention.

Referring to FIG. 1, there is illustrated a support tube 10 within which a conductor 12 is positioned. The conductor is maintained in spaced relationship with respect to tube 10, and the latter is electrically grounded. Consequently, tube 10 and conductor 12 operate as a coaxial cable.

A pair of tubular members 14 and 16 are joined at their ends to support tube 10. Each of the members 14 and 16 is formed such that it cooperates with tube 10 to define a rectangular outline. The length of each rectangle, corresponding to the distance between the points where the tubular member intersects the tube 10, is selected to approximate half the wavelength of the carrier frequency to be transmitted. The width of each rectangle is approximately an eighth of the carrier frequency wavelength.

The tubular members 14 and 16 are arranged to be coplanar, and they are joined to tube 10 at corresponding points along a common length of the tube such that peripheries of members 14 and 16 define a rectangle approximately a half wavelength long and a quarter wavelength wide.

A length of tubing 18 extends between the center of tubular member 14 and a location A on support tube 10 which is equidistant from the points where member 14 contacts tube 10. Thus, tubing 18 divides the rectangle defined by member 14 and tube 10 into two substantially equal rectangles each a quarter wavelength long and an eighth of a wavelength wide.

An additional piece of tubing 20 is bent into an L-shape and extends between the center of tubular member 16 and a point B on member 16 immediately adjacent a location where the end of member 16 joins support tube 10. Consequently, a gap C is defined between the bend D of tubing 20 and the location A on tube 10.

An aperture 22 is provided in support tube 10 between location A and that intersection of tubing 16 with tube 10 which is adjacent to point B. A conductor 24 extends from conductor 12 through the aperture to engage a conductive strap 26 which is secured to tubing 20 at a point E intermediate bend D and point B. The conductor 24 and strap 26 are insulated from tube 10 by conventional means (not shown) which also seals the aperture so that gas may be maintained under pressure within tube 10 to prevent entry of moisture to the area within the tube.

While the embodiment just described employs a conductor 12 within support tube 10 to supply energy to the antenna element it is apparent that other means for energizing the antenna can be utilized. For example, a coaxial cable may be provided exterior of the tube 10 with the central conductor of the cable being connected to tubing 20 and the cable's shield being joined to tube 10.

Whatever the arrangement employed for supplying energy to the antenna element, support tube 10 is maintained at ground potential. Consequently, a high impedance exists across the gap C while point B of tubing 20 is at ground potential. Thus, if the impedance of the line energizing the antenna is less than that across gap C, the point E along tubing 20 between location D and point B can be selected for connection of the energy-carrying conductor (such as strap 26) so that the antenna element is matched to the impedance of the supply line.

Since maximum energy of the antenna occurs across gap C, the intersections of the tubular members 14 and 16 with support tube 10 at distances a quarter wavelength from location A results in a balun being achieved whereby there is substantially no energy where the tubular members 14 and 16 join tube 10.

With the antenna element oriented in the manner shown in FIG. 1, vertical polarization is obtained. However, by rotating the element 90° so that the major lengths of tubular members 14 and 16 are vertical, horizontal polarization occurs. In either case, the antenna element produces cross-polarization of more than 33db.

Due to the extremely broad bandwidth of the antenna element, the dimensions of the tubular members need only be roughly established by the frequency of the wave to be emitted.

Figure 2:
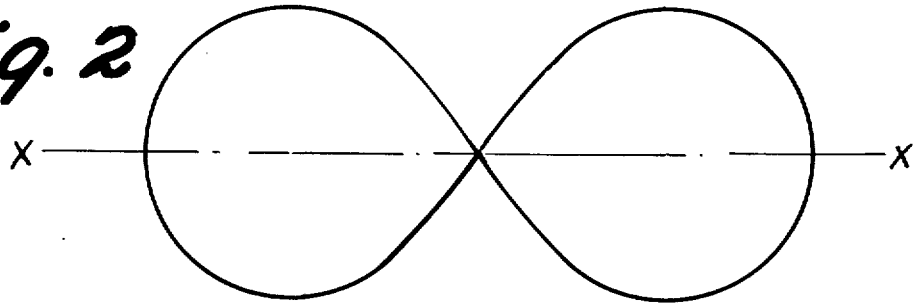
FIG. 2 is a typical radiation pattern obtainable utilizing the antenna element of FIG. 1.

FIG. 2 generally illustrates the directional radiation pattern of a single antenna element of the type just described. While the drawing shows the pattern in only one plane, its three-dimensional configuration can be appreciated by rotating the drawing 360° about axis X—X. While the pattern illustrated approximates a pair of balloons held end-to-end, the spatial configuration in actual practice more closely resembles two ice cream cones held end-to-end.

Figure 3:
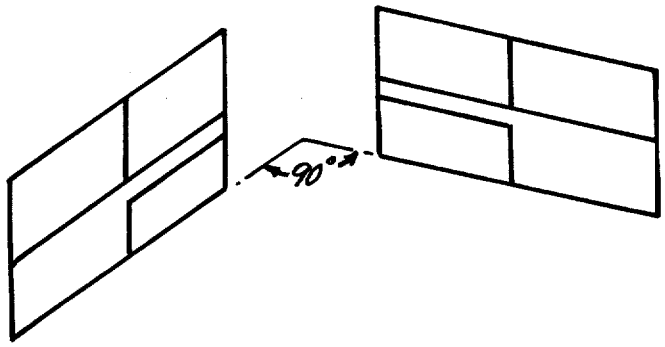
FIG. 3 is a schematic diagram illustrating the orientation of a pair of antenna elements, of the type shown in FIG. 1, in order to obtain a non-directional radiation pattern with vertical polarization.
Figure 4:
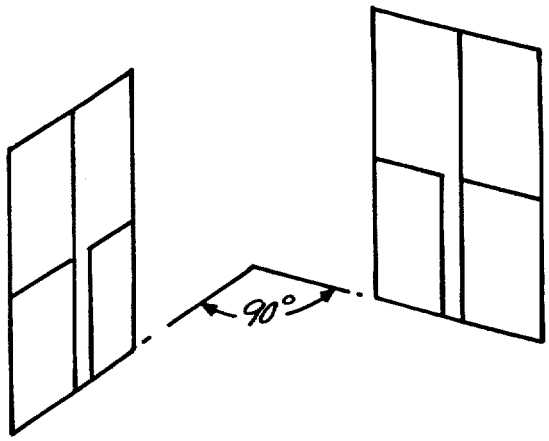
FIG. 4 is a schematic diagram illustrating the orientation of a pair of antenna elements, of the type shown in FIG. 1, in order to obtain a non-directional radiation pattern with horizontal polarization.

FIGS. 3 and 4 illustrate a pair of antenna elements arranged to produce nondirectional patterns of vertical and horizontal polarization, respectively, when the antenna elements are energized in quadrature. As can be appreciated from the drawings, the planes of the two antenna elements are physically mounted at 90° to one another.

Figure 5:
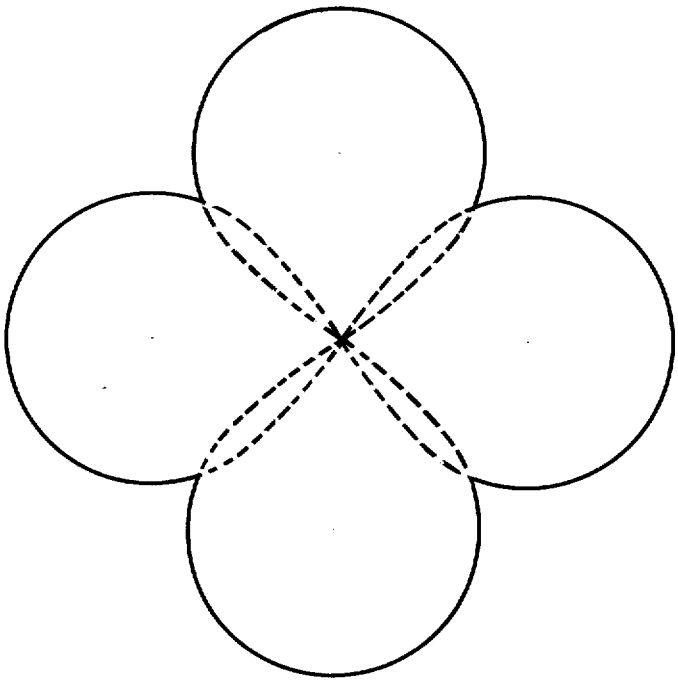
FIG. 5 is a typical non-direction radiation pattern obtainable utilizing the antenna arrangements illustrated in FIGS. 4 and 5.

The non-directional radiation pattern of antenna elements arranged according to FIGS. 3 and 4 is illustrated in FIG. 5. Each of the lobes has an individual spatial configuration comparable to those described with respect to FIG. 2. However, since the lobes overlap (as shown in dotted lines), the composite pattern is as illustrated in FIG. 5.

Although the foregoing descriptions have been of a single antenna element for directional radiation and a single pair of antenna elements for non-directional transmission, it will be appreciated that additional elements may be employed to intensify signal strength by spacing such elements along a mast at wavelength intervals. Also, while the antenna element has been described as being formed from tubes, other electrical conductive materials such as rod, angle iron wire or the like may be utilized.

What is claimed is:

1. An antenna comprising:

an electrically conductive support element;

a first electrically conductive member joined at its ends to spaced points along said support element;

a second electrically conductive member joined at its ends to the support element at points proximate said spaced points;

a first length of conductive material connected between the center of said first member and a location along said element substantially midway between said spaced points;

a second length of conductive material connected between the center of said second member and a location adjacent one of said spaced points, said second length of material being formed to define a gap between the second length of material and the support element at said location substantially midway between the spaced points; and means for supplying energy to the second length of conductive material at a point intermediate the gap and said location adjacent one of the spaced points.

2. An antenna as set forth in claim 1, wherein said support element is a tube.

3. An antenna as set forth in claim 2, wherein said energy supplying means comprises a conductor within said tube and conductive means passing through an aperture in said tube to interconnect the conductor and said second length of conductive material.

4. An antenna as set forth in claim 1, wherein at least one of said electrically conductive members is formed such that in cooperation with said support element a rectangle is defined.

5. An antenna as set forth in claim 4, wherein said electrically conductive members are arranged to be coplanar.

6. An antenna as set forth in claim 4, wherein the distance between the ends of said conductive member approximates a half wavelength of a signal transmitted by said antenna.

7. An antenna as set forth in claim 4, wherein the distance between said support element and a parallel portion of said conductive member approximates an eighth wavelength of a signal transmitted by said antenna.

8. An antenna as set forth in claim 4, wherein both of said conductive members cooperate with said support members to define a pair of rectangles.

9. An antenna as set forth in claim 8, wherein said electrically conductive members are arranged to be coplanar.

10. An antenna as set forth in claim 8, wherein the distance between the ends of the respective conductive members approximates a half wavelength of a signal transmitted by said antenna.

11. An antenna as set forth in claim 8, wherein the distance between said support element and parallel portions of said conductive members approximates an eighth wavelength of a signal transmitted by said antenna.

12. An antenna as set forth in claim 11, wherein said electrically conductive members are arranged to be coplanar.

13. An antenna as set forth in claim 1, wherein said second length of conductive material is substantially L-shaped and engages the second conductive member both at the center of the member and at a point proximate an end thereof.

14. An antenna as set forth in claim 13, wherein said gap extends between the support element and a bend in the second length of conductive material which defines its L-shape.

* * * * *